United States Patent [19]

Kure et al.

[11] Patent Number: 4,470,725

[45] Date of Patent: Sep. 11, 1984

[54] OFFSHORE PLATFORM STRUCTURE INTENDED TO BE INSTALLED IN ARCTIC WATERS, SUBJECTED TO DRIFTING ICEBERGS

[75] Inventors: Gregers Kure, Nesbru, Norway; Dag N. Jenssen, Houston, Tex.; Kolbjørn Naesje, Sandnes, Norway

[73] Assignees: Ingenior Thor Furuholmen A/S; A/S Hoyer-Ellefsen; Ingenior F. Selmer A/S, all of Oslo, Norway

[21] Appl. No.: 353,351

[22] Filed: Mar. 1, 1982

[51] Int. Cl.[3] ..... E02B 3/22; E02D 21/00

[52] U.S. Cl. ..... 405/212; 405/217

[58] Field of Search ..... 405/195, 207, 210–212, 405/216, 217

[56] References Cited

U.S. PATENT DOCUMENTS

| | | | |
|---|---|---|---|
| 3,165,898 | 1/1965 | Elliott | 405/207 |
| 3,793,840 | 2/1974 | Mott et al. | 61/46.5 |
| 3,921,558 | 11/1975 | Redshaw | 405/210 X |
| 4,019,332 | 4/1977 | Lamy | 405/211 |
| 4,215,952 | 8/1980 | Baardsen | 405/211 |
| 4,241,685 | 12/1980 | Mougin | 405/210 X |
| 4,252,471 | 2/1981 | Straub | 405/211 |

FOREIGN PATENT DOCUMENTS

| | | | |
|---|---|---|---|
| 1081483 | 7/1980 | Canada | 405/211 |
| 142038 | 6/1980 | Norway . | |

*Primary Examiner*—Cornelius J. Husar
*Assistant Examiner*—Nancy J. Stodola
*Attorney, Agent, or Firm*—Fleit, Jacobson, Cohn & Price

[57] ABSTRACT

An offshore platform structure, particularly intended to be installed in waters where drifting iceberg frequently appear, the platform structure being intended to be founded in a sea bed and comprises a substructure, a superstructure rigidly affixed to the substructure and extending vertically up above the sea level supporting a deck superstructure at its upper end. The horizontal cross-sectional area of the substructure is substantially greater than that of the superstructure. The substructure rigidly supports a fender structure, the fender structure comprising an outer peripherally arranged wall and an inner cylindrical wall the inner and outer wall being rigidly interconnected by means of a plurality of vertical and/or horizontal partition walls, dividing the fender structure into a plurality of cells or compartments. The fender structure is arranged in spaced relation with respect to the superstructure.

10 Claims, 6 Drawing Figures

OFFSHORE PLATFORM STRUCTURE INTENDED TO BE INSTALLED IN ARCTIC WATERS, SUBJECTED TO DRIFTING ICEBERGS

FIELD OF THE INVENTION

The present invention relates to an offshore platform structure, preferably made of concrete, and particularly but not exclusively designed to operate in waters where drifting ice and/or iceberg may appear. More particularly, the platform structure is of a gravity type intended to be supported by the sea bed in areas where collisions between drifting icebergs and a platform may take place. The platform structure comprises a substructure intended to rest on the sea bed and a superstructure rigidly affixed to the substructure and extending therefrom up above the sea level preferably to support a deck superstructure above the sea level.

The exploration of and discoveries of subaqueous oil and gas in the artic waters require drilling—and production platform structure which may resist the impact forces caused by colliding drifting icebergs of enormous size.

Principally, there are two main ways to solve the problems caused by drifting icebergs, namely either by designing a platform structure which enables evacuation of the platform structure on short notice whenever a collision is likely to occur, or by designing a platform structure which is sufficiently large, rigid and strong to resist the impact loads caused by a colliding drifting iceberg.

The latter solution is to be preferred since a continuous oil and gas production and protection of the environment from pollution is imperative.

The impact energy or forces imposed by icebergs colliding with the platform structure may be enormous. By far the governing loading condition for the platform structure is the one exerted by ice impact which gives a concentrated loading. Consequently, the structure should provide a wide spread of internal forces so that all of most members take part in carrying the load. Further, the geometry of the platform structure should be such as to minimize out-of-plane sectional forces for the members in the caisson and one should instead aim at a configuration giving only in-plane forces.

The structure should also be designed to withstand iceberg impact for any direction, and the external wall(s) of the caisson should preferably be provided with vertical triangular protrusions evenly distributed along the entire periphery of the caisson. The purpose of said vertical protrusions is to dissipate significant energy by crushing of the ice and/or the protrusion wall(s). The protrusions should preferably be given relatively small size in order to be equally effective in crushing ice irrespective of the impact direction of the iceberg. Also, the walls in the protruding parts are able to withstand relatively high ice forces acting locally on a single wall.

PURPOSE OF THE INVENTION

A major object of the present invention is to provide a platform structure where the vital parts of the platform such as for example the superstructure supporting the deck superstructure are arranged in spaced relation to those sections exposed to impact forces caused by drifting icebergs. It should be appreciated that the section intended to be exposed to environmental forces such as impact forces are designed to withstand forces up to a certain level and finally to collapse locally if exposed to excessive, continuous overloading. Vital sections such as oil storage compartments, living quarter, drilling and production equipment, conductors etc. are centrally arranged, these structures being structurally separated from said sections intended to be subjected to environmental loads.

A further object of the present invention is to design a simple, rigid structure which preferably may be constructed, using the slip forming technique and which may be built and mechanically outfitted in sheltered waters, preferably inshore.

SUMMARY OF THE INVENTION

According to the present invention these objects are achieved with a platform structure comprising a substructure which, when in installed position on the sea bed, is completely submerged, a superstructure rigidly affixed to the substructure, extending vertically up from the substructure and up above the sea level and a deck superstructure supported by the superstructure above the sea level. The cross-sectional area of the superstructure is substantially less than that of the substructure. The substructure has preferably a circular or polygonal cross-sectional area. The substructure is further compartmented, while the superstructure preferably comprises one or more cells extending from the base slab of the substructure up to the deck superstructure. The platform structure comprises further a cylindrical, ring-shaped fender structure rigidly supported by and affixed to the substructure. The fender structure comprises an outer and an inner wall which are interconnected by a plurality of horizontal and/or vertical diaphragm walls, thereby providing a plurality of separated compartments. The inner wall of the fender structure is structurally separated from the centrally arranged superstructure.

According to one embodiment the outer wall and/or the diaphrahm walls are dimensioned to yield locally and ultimately collapse when exposed to an excessive, continuing impact load caused by a drifting iceberg. Further, the weight of the structure and optionally the weight of the added ballast should be sufficient to keep the platform in position without tilting when subjected to overturning moments caused by a drifting iceberg.

The fender structure extends preferably from the substructure and up above the sea level. It should be appreciated, however, that the fender structure optionally may be terminated below the sea level.

The platform structure according to the present invention is preferably made of concrete, the substructure, the superstructure and the fender structure preferably forming an integral monolithic structure, the horizontal and vertical diapraghm walls forming an integral unit with the vertical outer and/or inner walls.

BRIEF DESCRIPTION OF THE DRAWINGS

A limited member of preferred embodiments will be described in further detail in conjunction with the attached drawings, wherein.

DESCRIPTION OF THE PRESENTLY PREFERRED EMBODIMENT

Figure 1:
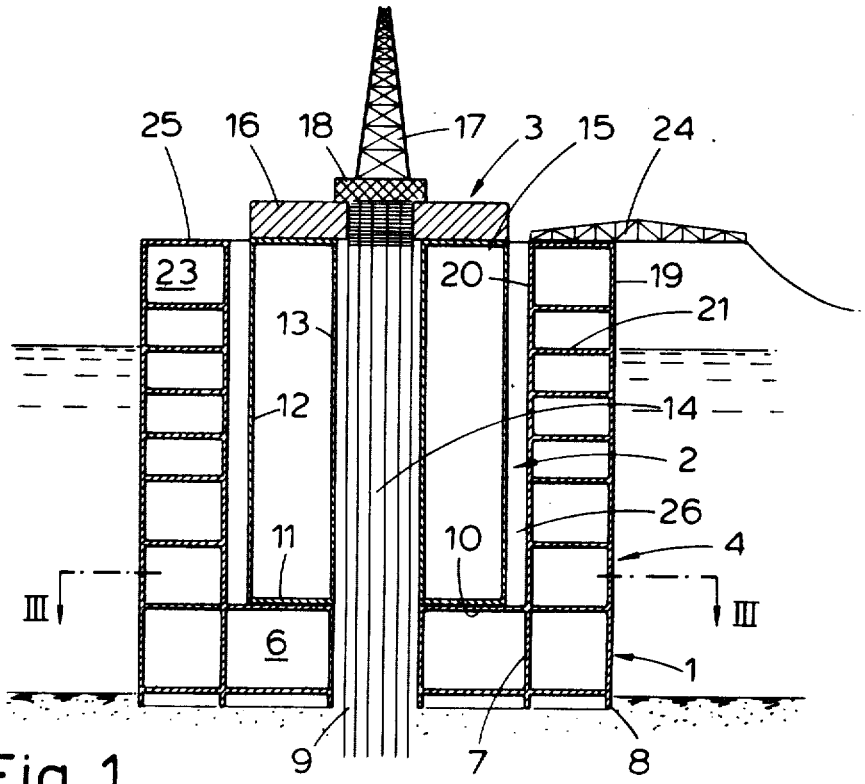
FIG. 1 shows schematically a vertical section through a platform in accordance with the present invention, the section being seen along line I—I in FIG. 2.
Figure 2:
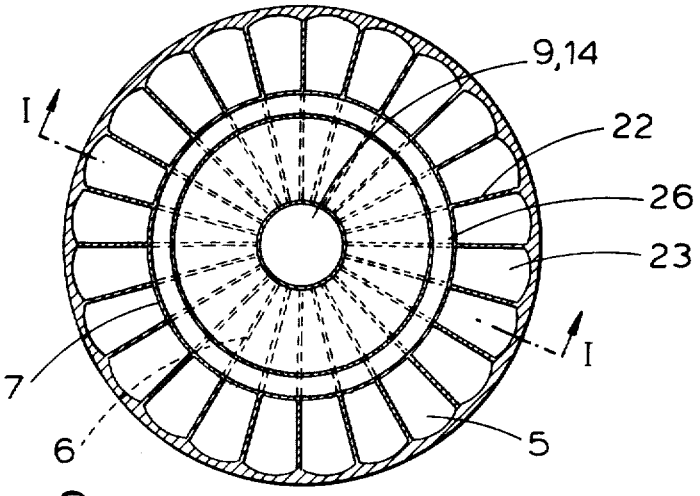
FIG. 2 shows a horizontal section through the platform shown in FIG. 1, the section being seen along the line II—II in FIG. 1.

FIGS. 1 and 2 shows a platform structure comprising a substructure 1, a superstructure extending vertically up from the substructure 1 and a deck superstructure 3, supported by the superstructure 2 above the sea level. The substructure 1 has a substantially larger cross-sectional area then that of the superstructure 2, the substructure 1 extending radially in horizontal direction beyond the superstructure. The substructure 1 supports a cylindrical ring-shaped fender structure 4 in spaced relation from the superstructure, surrounding the superstructure 2. The object of the fender structure 4 is to protect the superstructure 2 from iceberg impacts.

The substructure is buoyant and is divided into a plurality of segmental-formed cells or compartments 5 by means of vertical, radially arranged partition walls 6 and concentrically arranged ring wall(s) 7. At its lower end the substructure 1 is provided with a downwardly protruding skirt structure 8 founding the platform structure to the sea bed. Centrally through the platform and the skirt structure 8 a vertical cell 9 is arranged, extending from the deck superstructure 3 and down to the sea bed. As previously pointed out the substructure 1 rigidly supports the superstructure 2, the superstructure 2 being co-axial with the substructure. The lower end of the superstructure 2 is built-in to the substructure 1, the substructure 1 and the superstructure forming a monolithic unit. The top 10 of the substructure 1 serves as bottom slab 11 for the superstructure. The superstructure 2 comprises further a circumferential, cylindrical outer wall 12 and a cylindrical inner wall 13, the latter also serving as enclosure for the cell 14 forming the vertical well. The cell 14 coincides with the corresponding central cell 9 in the substructure. At the upper end 15 of the superstructure a deck superstructure 16 supporting drilling rig 17 etc. is affixed. The deck superstructure 16 is provided with a centrally arranged opening 18 coinciding with the cell 14 of the superstructure 2 and the cell 9 of the substructure, thereby forming a vertical cell extending from the sea bed to the deck superstructure 16. Said vertically extending cell contains conductors, drilling strings, etc. dependent on the functions which the platform structure is to serve. According to the embodiment shown in FIGS. 1 and 2 the platform structure serves as a platform for production of oil and gas. Consequently, the peripherally arranged cell(s) of the superstructure 2 is used for storing hydrocarbons, provided with a separate bottom slab 11 which may form an integral unit with the top plate 10 of the substructure. The cells 5 in the substructure 1 may, when the platform structure is installed on the sea bed, be filled with the appropriate weight of ballast.

The outer cylindrical wall 19 of the cylindrical ring-shaped fender structure 4 is made as a continuation of the corresponding outer, peripheral wall of the substructure 1. Further, the inner cylindrical wall 20 of the fender structure 4 is made as a direct continuation of a corresponding ring-formed wall 7 in the substructure 1. The inner cylindrical wall 20 is arranged in spaced relation with respect to the outer wall 12 of the superstructure 2. The radial distance between the inner wall 20 of the fender structure 4 and the outer wall 12 of the superstructure 2 is such that forces or impact energy absorbed by the fender structure 4 may not be transferred to the superstructure 2. The walls 19 and 20 of the fender structure is rigidly interconnected by means of horizontal and/or vertical diaphragm walls 21 and 22, respectively the vertical walls 21 being radially arranged. Consequently, the the fender structure is divided into a plurality of separated compartments or cells 23.

Figure 3:
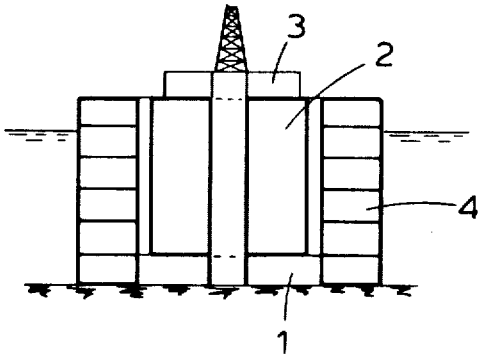
FIGS. 3, 4 and 5 show schematically a vertical section through three different embodiments of the platform according to the present invention.

The upper end of the fender structure 4 may preferably function as a platform deck and/or supporting sections of the deck superstructure. Further, equipment such as for instance cranes 24, mooring winches etc. may be arranged on top of the fender structure 4. The top end 15 of the superstructure 2 may be provided with a radially extending, horizontal top slab (not shown), extending laterally to the top 25 of the fender structure 4. The intermediate space 26 between the supporting superstructure 2 and the fender structure 4 is preferably filled with sea water. FIG. 3 shows a second embodiment of the present invention which basically resembles the embodiment shown in FIGS. 1 and 2. A major difference is, however, that the bottom slab of the superstructure 2 and the top of the substructure 1 is formed as a single uniform plate with a thickness corresponding to the thickness of the remaining sections of the top slab of the substructure. Further, the radial thickness of the fender structure is increased. As shown in FIG. 1 the fender structure projects up above the sea level.

Figure 4:
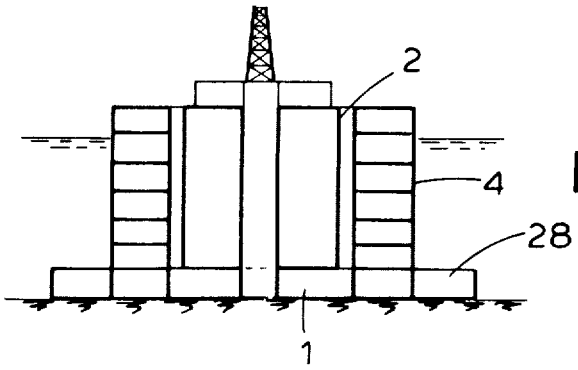

According to the embodiment shown in FIG. 4 the substructure 1 extends laterally beyond the lateral extension of the fender structure 4, forming a ring-formed, peripherally arranged base structure 28, thereby improving the stability of the structure both during construction, towing and in installed state on the sea bed.

Figure 5:
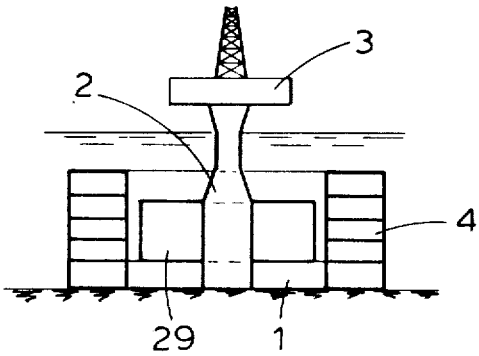

The fender structure 4 according to the embodiment shown in FIG. 5 is terminated below the sea level, allowing small icebergs to float over the fender structure, impacting the superstructure 2. According to such an embodiment it becomes more easy to handle, transport and lift equipment supplied by surface floating supply vessels, the supply vessel being moved to the platform structure during the loading and/or unloading stage. As shown in the Figure the superstructure 2 is formed of a single column while a separate storage tank 29 is concentrically arranged around the column 2. The storage tank 29 forms an integral unit both with the column and the substructure 1. The outer diameter of the tank 29 is substantially less than the inner surface of fender structure 4. Further, the storage tank 29 is terminated well below the upper end of the fender structure. A further major advantage of such embodiment is that the wave resistance is considerably reduced due to the reduced cross-sectional area in the region of the water line.

Figure 6:
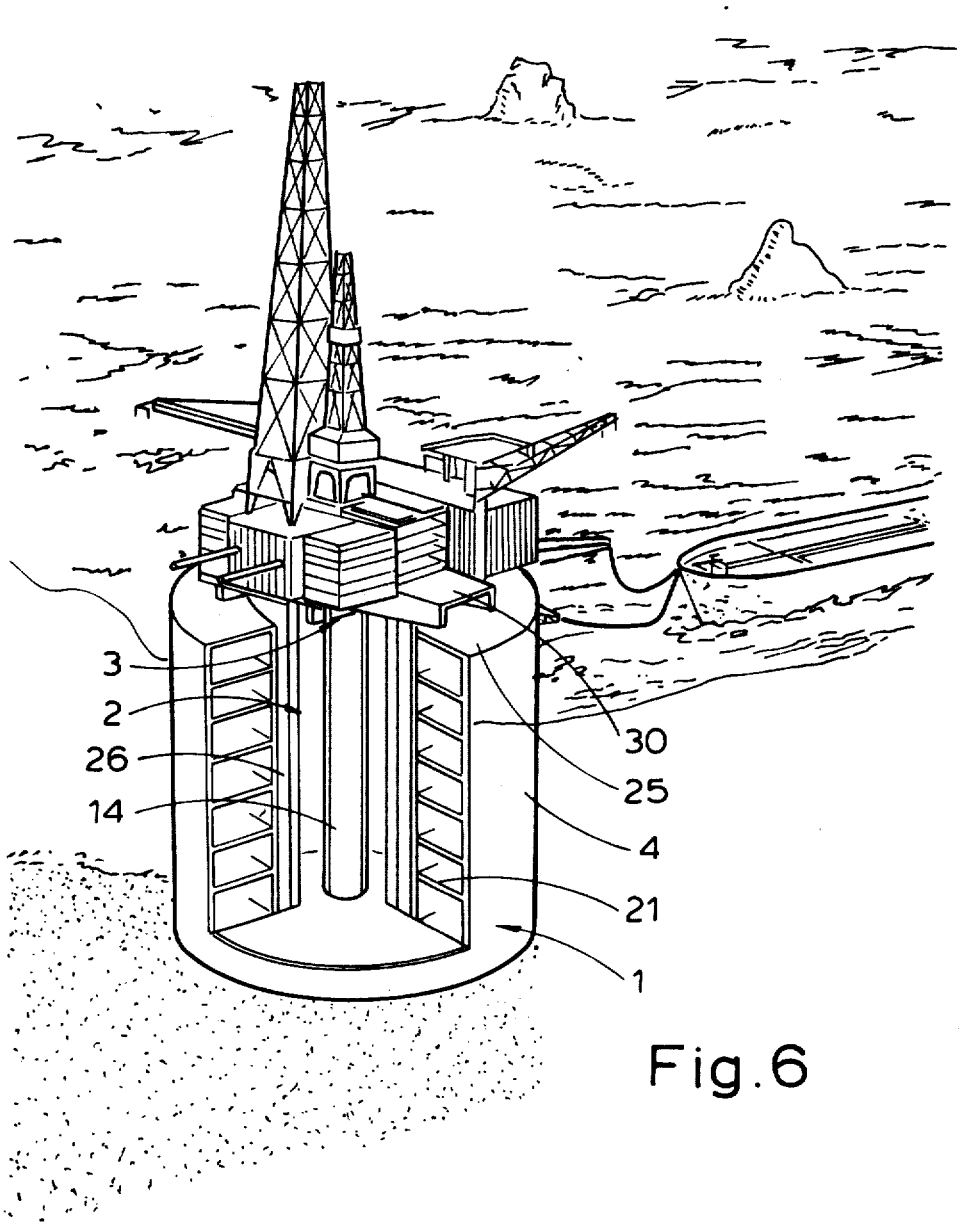
FIG. 6 shows an artist view, partly in section of a fully equipped platform installed on an offshore site.

FIG. 6 discloses an embodiment which substantially corresponds to the embodiment shown in FIGS. 1 and 2. The Figures show an artist's impression of such a platform structure installed on the sea bed and partly sectioned. As shown in the Figure the deck superstructure 3 comprises a plurality girders or concrete beams 30, extending radially out from the top of the superstructure 2 to the top section 25 of the fender structure 4. The horizontal diaphragm walls 22 are shown while the vertical, radially arranged walls 21 being flush with the corresponding vertical walls of the substructure are not shown.

Apart from FIG. 5, the Figures show a platform structure where the superstructure 2 is substantially formed as a plurality of concentrically arranged cylindrical cells. FIG. 5 shows an embodiment wherein the deck superstructure 3 is supported by a single column. It should be appreciated, however, that the superstructure may be formed of a plurality of separate columns being arranged in spaced relation. At least one of said columns may function as a well extending from the sea bed to the deck superstructure 5, housing conductors, risers, etc.

If the superstructure 2 is provided with a separate bottom slab 11, the superstructure 2 should be equipped with means for ballasting, preferably arranged in the vicinity of the slab 11.

The platform structure may be constructed in conventional manner, i.e. the construction of the bottom raft is executed in a dry dock, whereupon the draft is towed out to a deep water site where the remaining construction work is performed, preferably by means of slip forming, the structure being successively ballasted to maintain a constant free board during the constructional stage.

Finally, the deck superstructure is constructed, either by building the girders or beams in situ or by floating the deck superstructure 5 over the platform and then deballast the structure to lift the deck superstructure off the barges on which the deck superstructure is transported. Subsequently to the installation of the deck superstructure, the platform is towed out to the offshore site and installed by adding ballast to the various compartments, thereby lowering the structure down on to the sea bed to partly penetrate it. Sea water is preferably used as ballast. Optionally, sand may be applied.

Alternatively, the various sections of the platform may be constructed separately, and assembled in a floating state, either in sheltered waters inshore or offshore at the operational site. Openings, preferably closable, may be arranged in the cell wall(s) between the various cells or groups of contiguous cells. Further, a pipe system incorporating pumps, valves etc. may be incorporated, thereby enabling the cells to be ballasted or deballasted using sea water.

The platform structure and in particular the fender structure is designed to be able to withstand the maximum impact forces that may occur. However, if the impact forces imposed on the fender structure exceed the maximum expected impact forces, the outer section(s) of the fender structure is allowed to be locally deformed absorbing said impact forces. Optionally, even the inner wall of the fender structure may be locally deformed. Due to the lateral distance between the fender structure and the superstructure incorporating vital and fragile parts, the latter structure is still protected against the impact forces. It should further be appreciated that the design and dimensioning is based on the so-called "weak-link" principle, i.e. the platform structure is to be forced laterally along the sea bed if the impact forces becomes excessively high. Further, the platform structure is given such a weight and dimensions that the platform is prevented from tilting if the impact forces become exceedingly high.

What we claim is:

1. An offshore platform structure for installation on a sea bed in waters where impact from drifting icebergs may occur, said platform structure comprising:

a substructure having an upper portion and a lower portion, said lower portion adapted for support by the sea bed;

intermediate walls of said substructure located between said upper portion and said lower portion;

a superstructure having an end rigidly fixed to said upper portion of the substructure, said superstructure extending perpendicular to said upper portion of said substructure, and said superstructure having a smaller lateral dimension than said substructure;

a deck supported by said superstructure, said deck being supported above sea level; and a fender structure rigidly supported at a lower end of said fender structure by said substructure, said fender structure extending circumferentially around the superstructure, and said fender structure further being in spaced relation from said superstructure and said fender structure being structurally separated from said superstructure along at least a major portion of a length of said fender structure.

2. An offshore platform structure as claimed in claim 1, wherein the fender structure comprises an external wall and an internal wall and said fender structure being divided into a plurality of separate cells by means of horizontal and vertical diaphragm walls.

3. An offshore platform structure as claimed in claim 1, wherein the fender structure extends above the sea bed and terminates at a level corresponding to the level of the deck.

4. An offshore platform as claimed in claim 3, wherein the superstructure comprises a cylindrical cell having a bottom slab, the cylindrical cell being supported and being affixed to the upper portion of the substructure.

5. An offshore platform structure as claimed in claim 3, wherein the superstructure comprises two concentrically arranged cylindrical walls, a lower end of each wall rigidly affixed to the upper portion of the substructure, said upper portion of said substructure serving as a bottom slab in the cell formed between said two concentrically arranged cylindrical walls.

6. An offshore platform structure as claimed in claim 5, wherein the platform structure is provided with a centrally arranged cell extending from the sea bed to the deck.

7. An offshore platform structure as claimed in claim 6, wherein the deck comprises a plurality of horizontal beams extending laterally at least to an upper end of the of fender structure.

8. An offshore platform structure as claimed in claim 7, wherein the fender structure supports the beams forming the deck.

9. An offshore platform structure as claimed in claim 8, wherein the fender structure is terminated below the sea level when installed on the offshore site.

10. An offshore platform structure for installation on a sea bed in waters where impact from drifting icebergs may occur, said platform structure comprising:

a substantially cylindrical substructure resting on a sea bed;

a substantially cylindrical superstructure extending perpendicular to an upper portion of said substructure;

a lower end of the superstructure rigidly fixed to the substructure;

a deck supported by the superstructure, said deck being above the sea level, the substructure having a larger raidal dimension than that of the superstructure; and a fender structure, said fender structure supported by said substructure and said fender structure comprising a substantially cylindrical inner wall being in spaced relation from the superstructure, an outer peripheral wall, and a plurality of vertical and horizontal diaphragm walls rigidly connecting the inner and outer peripheral wall of said fender structure for dividing the fender structure into a plurality of separate cells, and said superstructure comprising a substantially horizontal bottom wall and said substructure having a substantially horizontal top wall portion supporting said bottom wall of the superstructure.

* * * * *